United States Patent [19]

Otten

[11] 3,973,158

[45] Aug. 3, 1976

[54] DEVICE COMPRISING AN ION SOURCE IN WHICH THE IONS ARE ACCELERATED IN A DIRECTION PERPENDICULAR TO A MAGNETIC FIELD OF HIGH INTENSITY

[75] Inventor: Adrianus Martinus Maria Otten, Eindhoven, Netherlands

[73] Assignee: U.S. Philips Corporation, New York, N.Y.

[22] Filed: May 8, 1974

[21] Appl. No.: 468,193

[30] Foreign Application Priority Data

May 15, 1973 Netherlands ..... 7306714

[52] U.S. Cl. ..... 313/362; 313/62; 313/363

[51] Int. Cl.² ..... H05H 7/08; H05H 13/00

[58] Field of Search ..... 313/62, 234, 363, 359, 313/362

[56] References Cited

UNITED STATES PATENTS 2,668,260 2/1954 Barnett et al. ..... 313/62 X 2,716,197 8/1955 Jones et al. ..... 313/62 X 3,794,927 2/1974 Fleischer et al. ..... 313/62 X

OTHER PUBLICATIONS

"A Biased Source for a Cyclotron," by J. R. J. Bennett, Nuclear Instruments and Methods, 86, (1970), pp. 13–17.

*Primary Examiner*—Palmer C. Demeo

*Attorney, Agent, or Firm*—Frank R. Trifari; George B. Berka

[57] ABSTRACT

An ion source structure comprising a tubular anode having an ion exit opening, an insulating layer of alundum, boron nitride or epoxy resin on its surface, a screen supported by said layer and an extractor electrode mounted on the screen opposite the exit opening.

6 Claims, 4 Drawing Figures

DEVICE COMPRISING AN ION SOURCE IN WHICH THE IONS ARE ACCELERATED IN A DIRECTION PERPENDICULAR TO A MAGNETIC FIELD OF HIGH INTENSITY

The invention relates to a device comprising an ion source in which the ions are formed in a discharge within an anode in a magnetic field of high intensity parallel to the axis of the anode and in which the ions are accelerated from an aperture in the anode in a direction perpendicular to that of the magnetic field by means of an extraction electrode which is present at a short distance from the said aperture and has a large potential difference with the anode, which extraction electrode is supported by a screen.

Such an ion source for a cyclotron is described in J.R.J. Bennet in "Nuclear Instruments and Methods" 86, 13–17, 1970. The ion source within the vacuum space is present approximately in the center of the cyclotron and consists of an anode tube having a cathode at either end. The strength of the magnetic field is several thousands of Gauss. The extraction electrode is formed by an apertured cap supported by a screen which is present at a distance of a few mm from the anode. The potential difference between the anode and the extraction electrode, the extraction voltage, is maximum 12 kV.

Such an ion source with extraction electrode in a cyclotron has various advantages as compared with the arrangement in which the ions are accelerated only under the influence of the high frequency field between the electrodes of the cyclotron. The gas discharge is not or hardly influenced by the high frequency field and the field conditions for the extraction can also be chosen to be optimum. Due to the pre-acceleration by means of the extraction voltage, ions can be accelerated during a much larger part of the half cycle of the high frequency alternating voltage. The so-called phase acceptance of the cyclotron is thus considerably more favourable. This holds in particular for a higher harmonic mode as is used in accelerating heavy particles.

A drawback of such an arrangement is, however, that a so-called E × B discharge between the anode and the screen which supports the extraction electrode can be formed in the strong extraction field and the magnetic field which is directed perpendicular thereto. The electrons accelerated under the influence of the electric field describe circular paths in the magnetic field in which the possibility of ionisation in the residual gas present may be so large that a considerable discharge occurs which forms a load for the high voltage source and necessitates restriction of the high voltage. A considerable sputtering also occurs in such a discharge.

It is the object of the invention to provide a construction which does not exhibit the abovementioned drawback.

According to the invention, in a device having an ion source in which the ions are formed in a discharge within an anode in a magnetic field of high intensity parallel to the axis of the anode and in which the ions are accelerated from an aperture in the anode in a direction perpendicular to that of the magnetic field by means of an extraction electrode which is present at a short distance from said aperture and has a large potential difference with the anode, which electrode is supported by a screen, the screen surrounds the full circumference of the anode in a cross-section perpendicular to the axis and the space between the screen and the anode is filled with an insulator with the exception of the emanating aperture for the ions.

An advantage of the construction according to the invention is that the permissible extraction voltage is more than doubled as compared with the known construction and that nevertheless no E × B discharge can occur between the anode and the screen. The advantages of the known arrangement with respect to discharge conditions and extraction conditions are also present to an increased extent. The construction is not only suitable for protons, deuterons and helium ions, but also for heavy ions, such as nitrogen, oxygen and argon. In the case in which the ion source has axial supply conductors for the electrodes and ducts for gas and cooling agent, according to the invention the screen and the insulator extend to within the poleshoes over such a distance that the magnetic field is too weak to produce an E × B discharge.

In the case in which the ion source has radial conductors and ducts, the screen and the insulator extend to within hollow metal arms surrounding the conductors and ducts. Insulation material is also provided in those places where an E × B discharge might occur within the arms.

The insulator between the anode and the extraction electrode may, according to the invention, advantageously consist of boron nitride. This material shows a high electric resistance and a large thermal conductivity. The low dielectric constant is favourable in connection with possible cavities. It is easy to machine.

Other suitable materials for the insulator are alundum or epoxy resins which are suitable for use in high vacuum, such as the one which is sold under the trade name of "Stycast".

Besides for cyclotrons, the ion source according to the invention may also be used in mass separators and generally in ion sources in a strong magnetic field.

The invention will be described in greater detail with reference to the embodiment shown in the drawing, in which FIG. 1 is a diagrammatic sectional view of the central part of a cyclotron, FIG. 2 is a longitudinal sectional view through an ion source for a device according to the invention with axial supplies.

Figure 1:
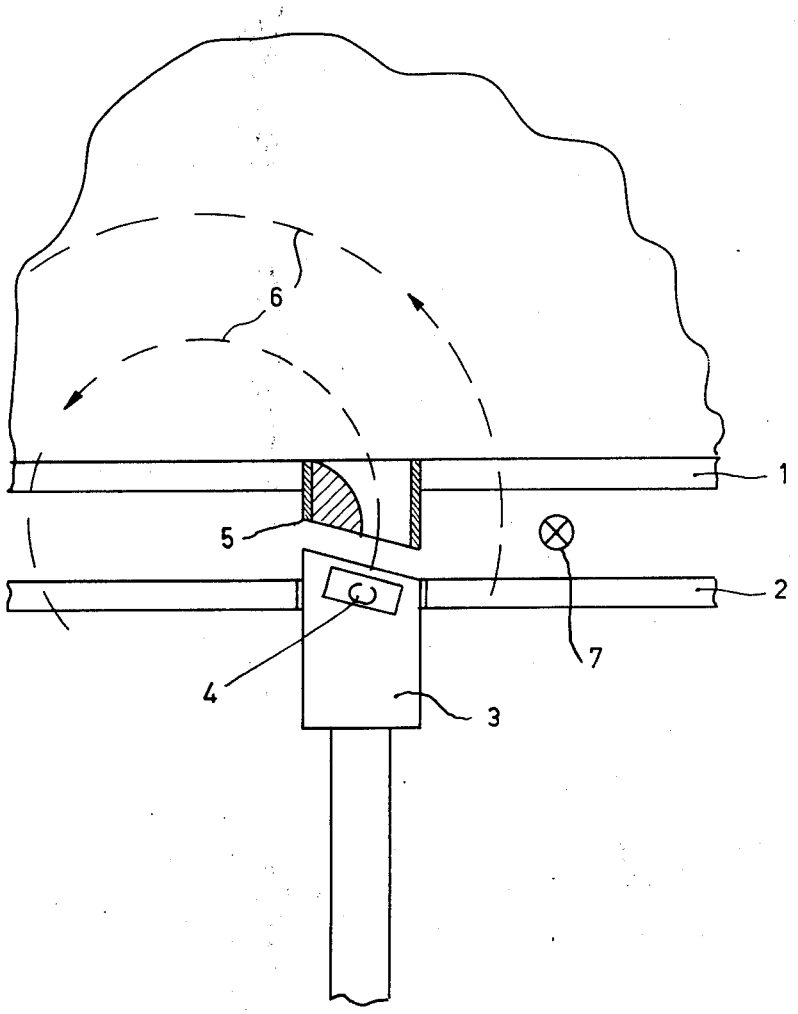

In FIG. 1 the D-electrode of the cyclotron is denoted by 1 and the counter-D-electrode by 2. The support 3 supports the ion source 4 from which the beam is accelerated by means of the suction electrode 5 by the high frequency electric field between the electrodes 1 and 2. The paths of the ions are denoted by broken lines 6. The magnetic field perpendicular to the plane of the drawing is denoted by 7.

Figure 2:
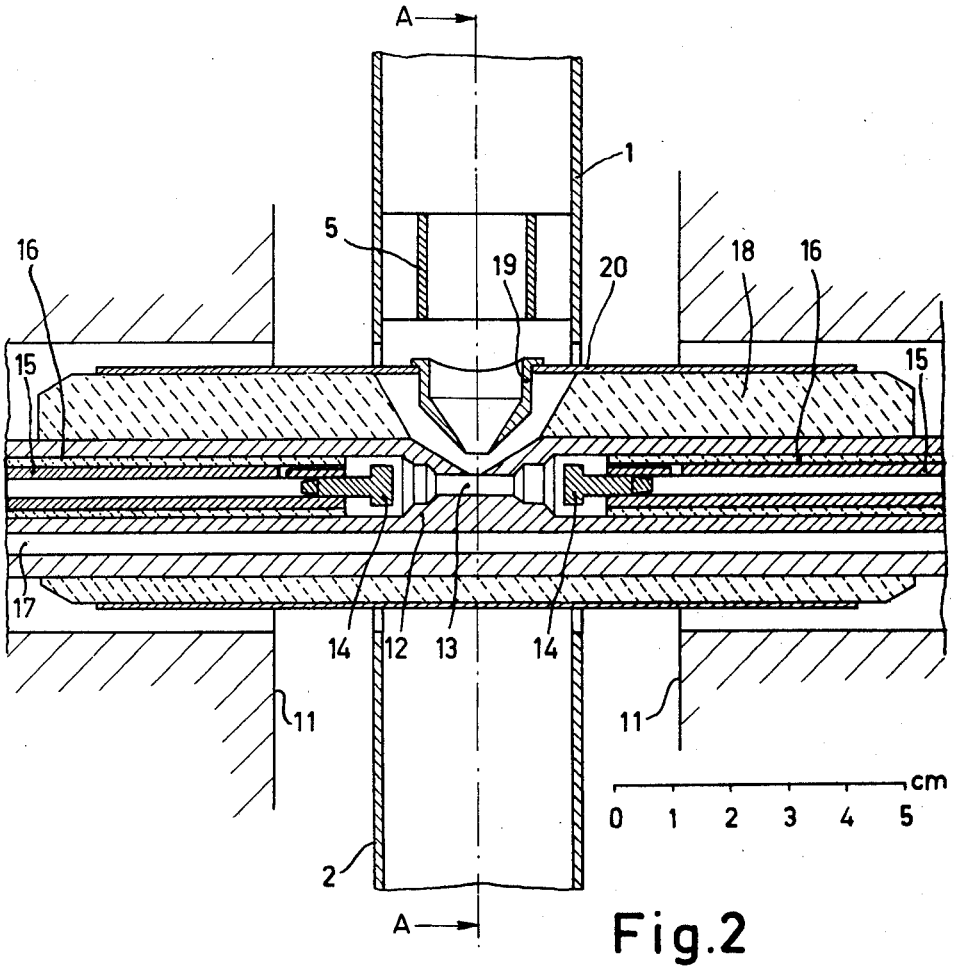
Figure 3:
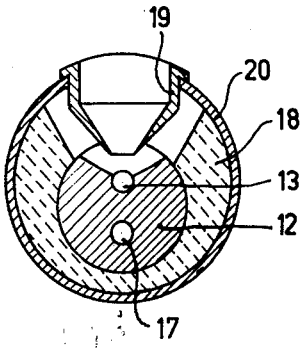
FIG. 3 is a sectional view perpendicular to the axis thereof.

In FIGS. 2 and 3 the magnet poles are denoted by 11. 12 is the copper anode block with the discharge channel 13 therein. The tantalum cathodes 14 are supported by copper tubes 15 which convey the gas to be ionized to the discharge space. The tubes 15 are insulated by means of alundum 16. The channel 17 for cooling water is present in the anode block 12. The insulator 18 consisting of boron nitride is present on the anode 13. The nozzle-like extraction electrode 19 is secured in the screen 20 which adjoins the insulator 18.

Figure 4:
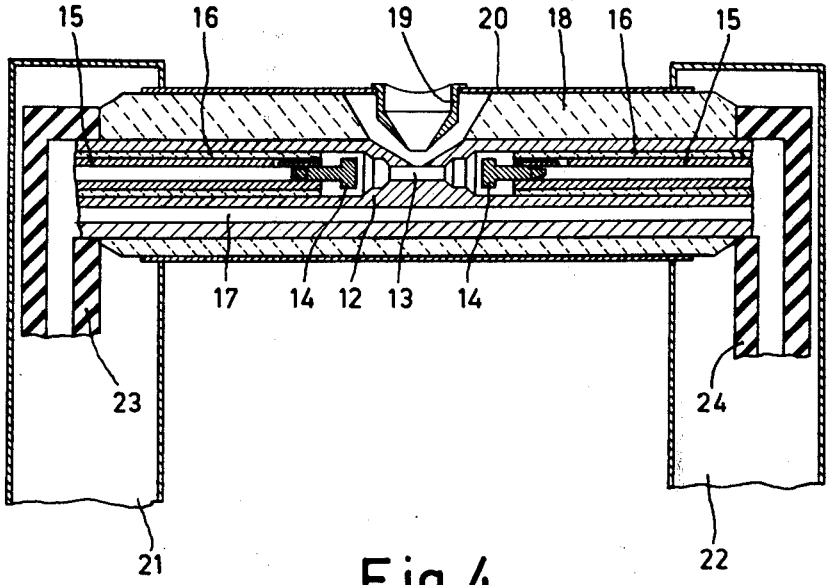
FIG. 4 is a longitudinal sectional view with radial supplies.

The dimensions of the ion source follow from the drawn scale in cm. With a magnetic field strength of 5 k. Gauss and a hydrogen pressure of approximately $10^{-3}$ Torr the positive voltage of the anode 12 relative to the screen 20 was 18 kV in which more than 25 kV would be admissible. The supply of the cathodes 14 is 2 kV negative relative to the anode. The operating voltage of the discharge between anode and cathodes is 200 to 400 V. The screen 20 and the counter-D-electrode 2 are at earth potential. Between the D-electrodes 1 and 2 is the high-frequency acceleratory voltage which can reach peak values of a few tens of kV. The frequency may be a few tens of MHz. In FIG. 4 the components corresponding to those of FIG. 2 are referred to by the same reference numerals. The screen 20 is accommodated in the arms 21 and 22 so as to be rotatable. Insulators 23 and 24 surround the transition (not shown) between the conductors and ducts in the arms 21 and 22 and the axial parts thereof. The insulators 23 and 24 are rotatable relative to the insulator 18.

As a result of the rotatability of the screen 20 in the arms 21 and 22 and the movability of the arms it is possible to arrange the ion source in any place between the magnet poles with any emanatory direction of the ions.

What is claimed is:

1. An ion source structure comprising a tubular anode provided with an ion exit aperture; means for establishing a magnetic field parallel to the axis of said anode, means for supplying ionizable gas into said anode; at least one cathode supported within said anode; an insulating layer covering the outer surface of said anode; a screen supported by said insulating layer and surrounding the curved outer surface of said anode; and an extractor electrode mounted on and passing through said screen opposite said exit aperture to accelerate the ions from exit aperture in a direction perpendicular to that of the magnetic field.

2. An ion source structure as claimed in claim 1 further comprising a tubular power supply conductor located in and insulated from said anode to support said cathode, and to supply gas to be ionized toward said exit aperture.

3. An ion source structure as claimed in claim 2 further comprising an axially directed duct provided within the wall of said anode to supply cooling agent.

4. A device as claimed in claim 3, wherein said insulating layer is selected from the group consisting of boron nitride, alundum and epoxy resin.

5. A device having a pair of opposite magnetic poles for producing a magnetic field of high intensity, an ion source having a tubular anode the axis of which is parallel to the magnetic field and including an ion exit aperture, means for supplying ionizable gas into said anode, an insulating layer on the outer surface of said anode, a tubular screen surrounding said insulating layer, an extraction electrode supported by said screen opposite said exit aperture, said screen being spaced from said magnetic poles at a distance sufficient for preventing $E \times B$ discharges.

6. A device as claimed in claim 5 further comprising hollow metal arms for movably supporting said ion source, said arms including an insulator abutting against said insulating layer on said anode and, within said insulator, power supply conductors and ducts communicating with corresponding conductors and ducts in said anode.

* * * * *